US011253752B2

(12) United States Patent
Jennings

(10) Patent No.: US 11,253,752 B2
(45) Date of Patent: Feb. 22, 2022

(54) TENNIS BALL RETRIEVAL SYSTEM AND METHOD

(71) Applicant: James Jennings, Lincoln, CA (US)

(72) Inventor: James Jennings, Lincoln, CA (US)

( * ) Notice: Subject to any disclaimer, the term of this patent is extended or adjusted under 35 U.S.C. 154(b) by 0 days.

(21) Appl. No.: 16/923,422

(22) Filed: Jul. 8, 2020

(65) Prior Publication Data

US 2020/0338398 A1 Oct. 29, 2020

Related U.S. Application Data

(63) Continuation-in-part of application No. 15/582,513, filed on Apr. 28, 2017, now abandoned.

(60) Provisional application No. 62/329,194, filed on Apr. 28, 2016.

(51) Int. Cl.

| | |
|---|---|
| ***A63B 47/02*** | (2006.01) |
| ***A63B 71/02*** | (2006.01) |
| ***A63B 69/38*** | (2006.01) |
| ***A63B 102/02*** | (2015.01) |

(52) U.S. Cl.

CPC ..... *A63B 47/021* (2013.01); *A63B 69/38* (2013.01); *A63B 71/023* (2013.01); *A63B 2071/025* (2013.01); *A63B 2102/02* (2015.10); *A63B 2225/50* (2013.01)

(58) Field of Classification Search

CPC ..... A63B 47/02; A63B 69/40; A63B 47/021; B60P 1/00

See application file for complete search history.

(56) References Cited

U.S. PATENT DOCUMENTS 3,819,049 A * 6/1974 Koerner ..... A63B 47/02 209/250
3,918,719 A 11/1975 Welch
5,529,307 A * 6/1996 Chang ..... A63B 57/0006 473/136
6,079,930 A * 6/2000 Valdes-Rodriguez ..... A63B 47/021 294/19.2
6,513,845 B2 * 2/2003 Campomane ..... A63B 47/02 294/19.2
6,834,776 B1 * 12/2004 Corvese ..... A63B 47/025 221/277
7,165,289 B1 * 1/2007 Gossage ..... A47L 5/365 15/314
7,341,294 B2 3/2008 Olmstead
7,674,196 B2 3/2010 Tsai
8,075,030 B2 12/2011 Pearson et al.
8,313,396 B1 * 11/2012 Mailman ..... A63B 47/021 473/460
8,602,711 B1 * 12/2013 Nash ..... A63B 47/021 414/440
9,022,016 B1 * 5/2015 Hafer ..... F41B 4/00 124/78
9,089,742 B2 7/2015 Vilar et al.
9,301,503 B1 * 4/2016 Arrighi ..... A63B 65/12
(Continued)

*Primary Examiner* — Eugene L Kim
*Assistant Examiner* — Christopher Glenn
(74) *Attorney, Agent, or Firm* — Theodore J. Bielen, Jr.

(57) ABSTRACT

A tennis-ball collector which includes a chassis, a drive train, an energy source, wheels, and a motor. The tennis-ball collector is useful for collecting scattered tennis balls after a game or practice without the need to bend and pick them up by hand. The device moves balls using a vacuum system or a drive belt.

4 Claims, 8 Drawing Sheets

(56) References Cited

U.S. PATENT DOCUMENTS

| | | | | |
|---|---|---|---|---|
| 2006/0068948 | A1* | 3/2006 | Mendoza | A63B 47/024 473/460 |
| 2006/0135290 | A1* | 6/2006 | Lin | A63B 69/406 473/451 |
| 2008/0032828 | A1* | 2/2008 | Alger | A63B 69/406 473/446 |
| 2008/0248901 | A1 | 10/2008 | Mosier et al. | |
| 2009/0137348 | A1* | 5/2009 | Tsai | A63B 47/021 473/436 |
| 2012/0196707 | A1* | 8/2012 | Thoman | A63B 69/406 473/436 |
| 2013/0064631 | A1* | 3/2013 | Leyco | A63B 47/021 414/439 |
| 2014/0274481 | A1* | 9/2014 | Harruna | A63B 69/40 473/431 |
| 2014/0294547 | A1* | 10/2014 | Guo | A63B 47/021 414/507 |
| 2015/0314206 | A1* | 11/2015 | Rehkemper | A63H 17/004 446/470 |
| 2015/0328503 | A1* | 11/2015 | Vilar | A63B 47/021 473/460 |
| 2016/0243970 | A1* | 8/2016 | Eletrabi | G05D 1/0891 |

* cited by examiner

FIG. 7A
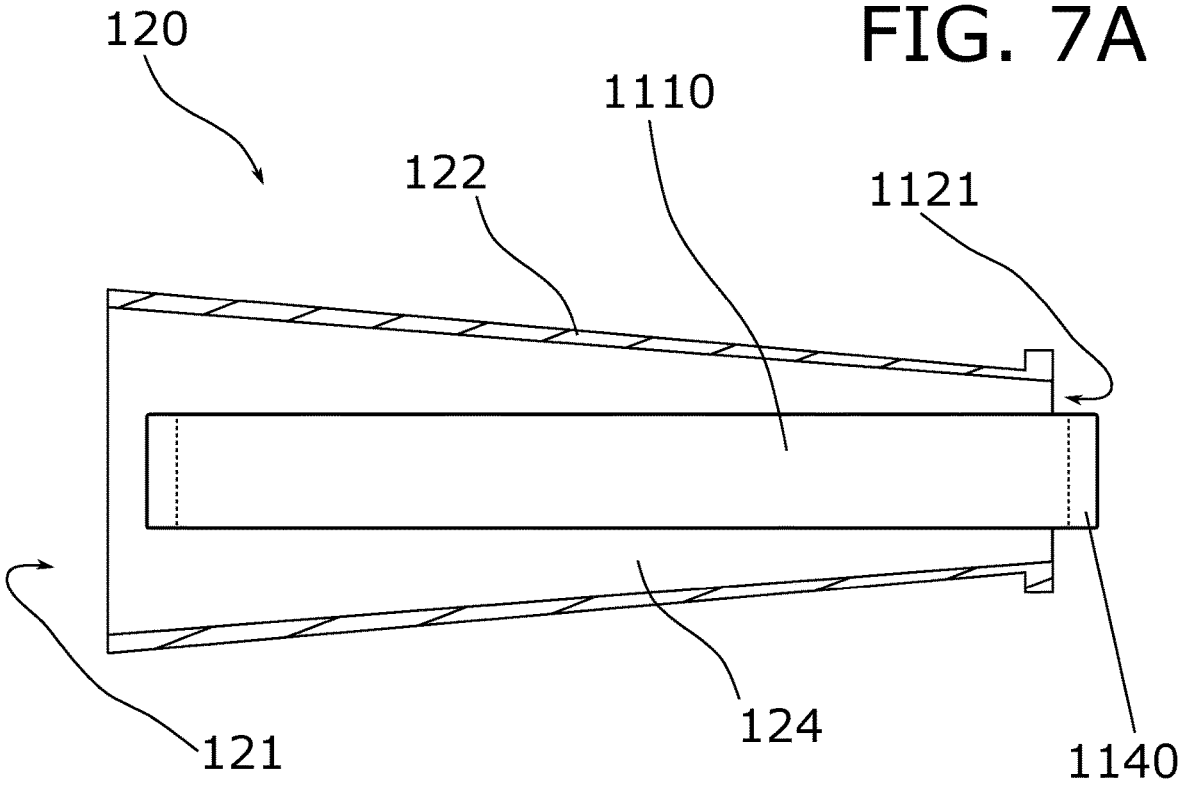
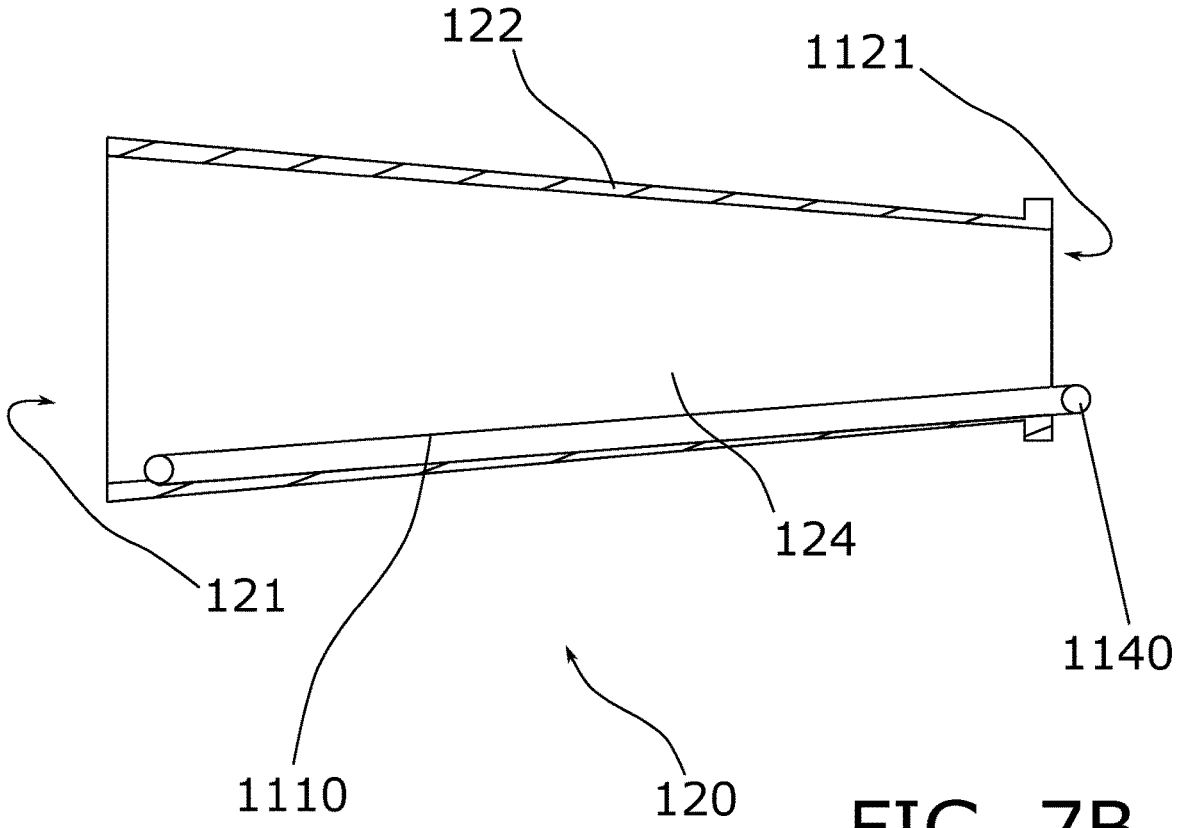
FIG. 7B

TENNIS BALL RETRIEVAL SYSTEM AND METHOD

CROSS-REFERENCE TO RELATED APPLICATIONS

The present application is related to and claims priority to U.S. patent application Ser. No. 15/582,513, filed Apr. 28, 2017, which is related to, and claims priority to U.S. Provisional Patent Application No. 62/329,194 filed Apr. 28, 2016; both of these documents are incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is explicitly or implicitly referenced is prior art.

TECHNICAL FIELD

The present invention generally relates to the field of ball retrieval devices of existing art and, more specifically, relates to machines used to collect tennis balls.

RELATED ART

During long tennis game sessions, many players experience pain in their extremities, especially in the legs, which makes collecting loose tennis balls after the game troublesome. While practicing at a tennis court, balls are often scattered around all areas of the court. When the practice is over, and it's time to collect the loose balls, many players experience fatigue, and it becomes painful to bend over repeatedly to collect these balls. The game of tennis is not only played by young individuals. Seniors often use it to exercise and remain healthy, as well. The task of continuously bending down to collect loose balls after a rigorous exercise routine may not be advisable for the players. Thus, a need exists for a remote-control device, which may aid in collecting scattered tennis balls.

U.S. Pat. No. 8,313,396 to Charles J. Mailman relates to a tennis ball vacuum collector. The described tennis ball vacuum collector includes a device for quickly picking up numerous tennis balls on a tennis court having a vacuum unit with angled collection members to funnel tennis balls into a location where suction from the vacuum unit draws the balls through tubing and a port into a basket within a chamber of the vacuum unit.

SUMMARY OF THE INVENTION

Because of the preceding disadvantages inherent in the tennis-ball collecting machines art, the present disclosure provides a novel tennis ball retrieval system.

A remote-control tennis-ball collector is disclosed. The tennis-ball collector includes a chassis, a drive train, an energy source, wheels, and a motor. The drive train may couple to the chassis such that the energy source, wheels, and a motor allow the chassis to move around the court. A ball collector includes a ball receiver, a collector, a ball channel, and a hopper. The ball collector may be mounted to the forward outer surface of the chassis for allowing balls to travel into the ball receiver, which activates the vacuum to suck the balls into and through the ball channel to the hopper. Alternatively, the ball collector may be mounted to the forward outer surface of the chassis for allowing balls to travel into the ball receiver, which activates the drive belt to move the balls into and through the ball channel to the hopper. In some versions, the ball collector is arranged to pass tennis balls through the hopper wall.

The collector is a remote-controlled vehicle, like a radio-controlled (RC) car or truck. A user has a transmitter to control the tennis-ball collector by transmitting movement commands to the device. The commands drive the tennis-ball collector toward a ball, making direct contact with the ball, which then activates the ball collector. The tennis-ball collector system may include an LED spotlight and a carrying handle coupled to the chassis. It can contain a receiver configured to receive signals from the transmitter.

The tennis-ball collector may use a battery pack such as a lithium-ion battery or rechargeable battery.

The tennis-ball collector may have at least two wheels. The hopper may be removably coupled to the tennis-ball collector to allow removal of the hopper.

According to another embodiment, a method of use for a tennis-ball collector system is also disclosed. The method of use for a tennis-ball collector system includes placing the tennis-ball collector system on the ground, powering on the tennis-ball collector system, using the remote control for controlling the tennis-ball collector system, collecting the balls, storing the balls in the hopper, removing the hopper to retrieve the collected balls, and storing the tennis-ball collector.

For purposes of summarizing the invention, certain aspects, advantages, and novel features of the invention have been described. Not necessarily all such advantages may be achieved per any one particular embodiment of the invention.

Thus, the invention may be embodied or carried out in a manner that achieves or optimizes one advantage or group of advantages without necessarily achieving other advantages. The features of the invention which are believed to be novel are particularly pointed out and distinctly claimed in the concluding portion of the specification. The following drawings and detailed description more fully describe these and other features, aspects, and advantages of the ball collector.

BRIEF DESCRIPTION OF THE DRAWINGS

The figures which accompany the written portion of this specification illustrate embodiments and methods of use for the present disclosure, a tennis ball retrieval system, constructed and operative according to the teachings of the present disclosure.

FIG. 7A is a top section view of a ball receiver of a tennis-ball collector.

FIG. 7B is a front section view of a ball receiver of a tennis-ball collector.

DETAILED DESCRIPTION

Figure 1:
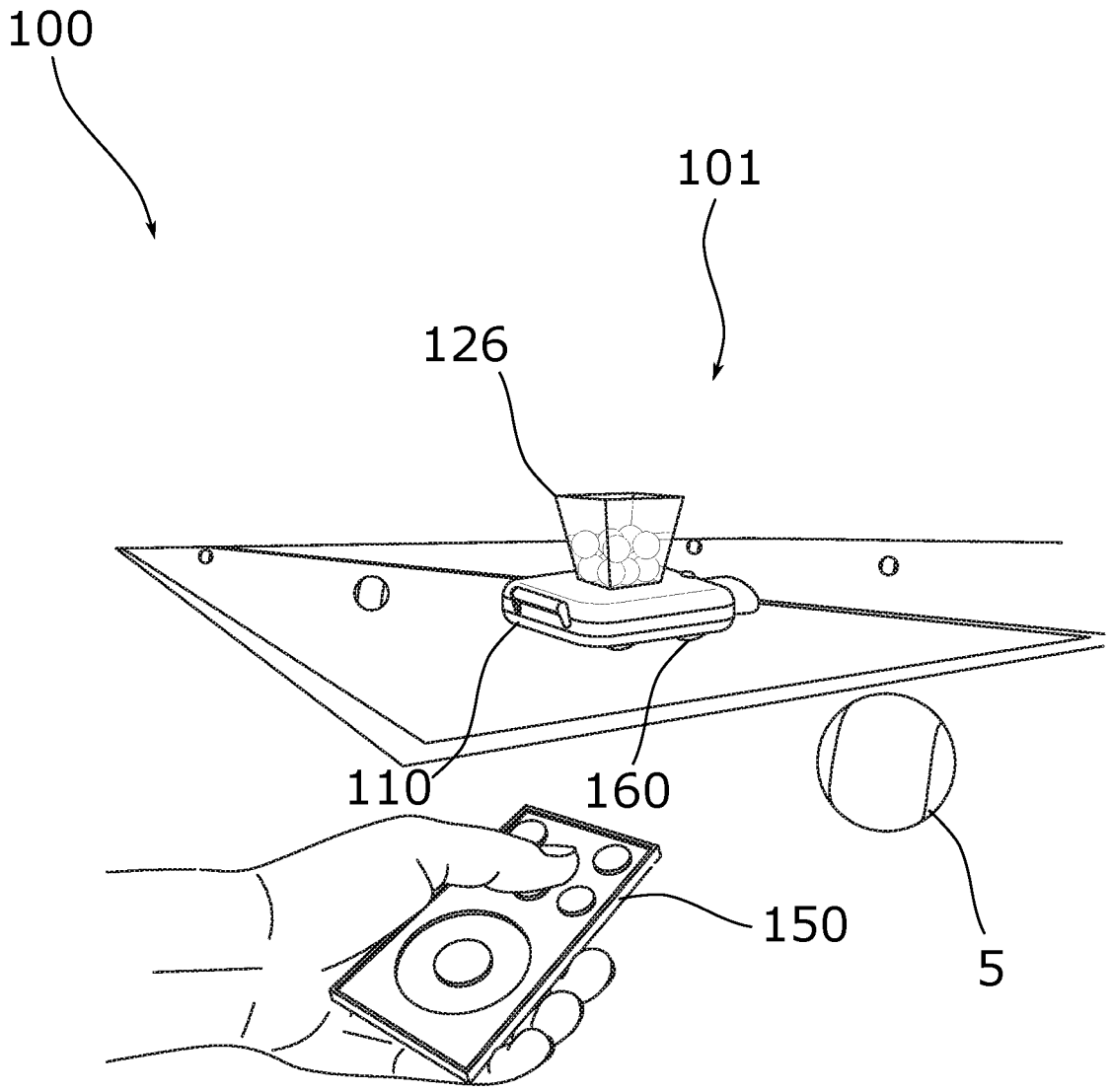
FIG. 1 is a perspective view of a tennis-ball collector during an 'in-use' condition.

As discussed above, embodiments of the present disclosure relate to a machine used to collect tennis balls and more particularly to a tennis ball retrieval system as used to improve the collection of scattered tennis balls after a game or practice without the need to bend and pick them up by hand.

A remote-controlled machine that may be used for retrieving tennis balls that are scattered throughout the court after a tennis game or practice session. The tennis ball collecting device may aid those who, after a rigorous game, find it hard to bend over and pick up the scattered tennis balls. The tennis ball collecting device may be remote-controlled with a handheld remote, allowing a user to collect the balls while sitting down. The player may use the remote to direct the machine to gather the balls around the court. The tennis ball collecting device may use a vacuum to suck the ball up and into a ball storage container. Alternatively, the device may use a motorized belt arrangement to move the tennis ball into the container (hopper). The tennis ball collecting device may use a light on the front or back to allow for night-time use. The tennis ball collecting device may have a handle to allow easy carrying from a vehicle to the court or where needed.

FIGS. 1-4 show various views of a tennis-ball collector system 100.

FIGS. 1-4 show a tennis-ball collector system 100 during an 'in-use' condition according to an embodiment of the present disclosure. Here, tennis-ball collector system 100 may collect scattered tennis balls 5 after a game or practice without the need to bend and pick them up by hand. As illustrated, tennis-ball collector 101 may include chassis 110, drive train 130, energy source, wheels 160, and motor.

Figure 2:
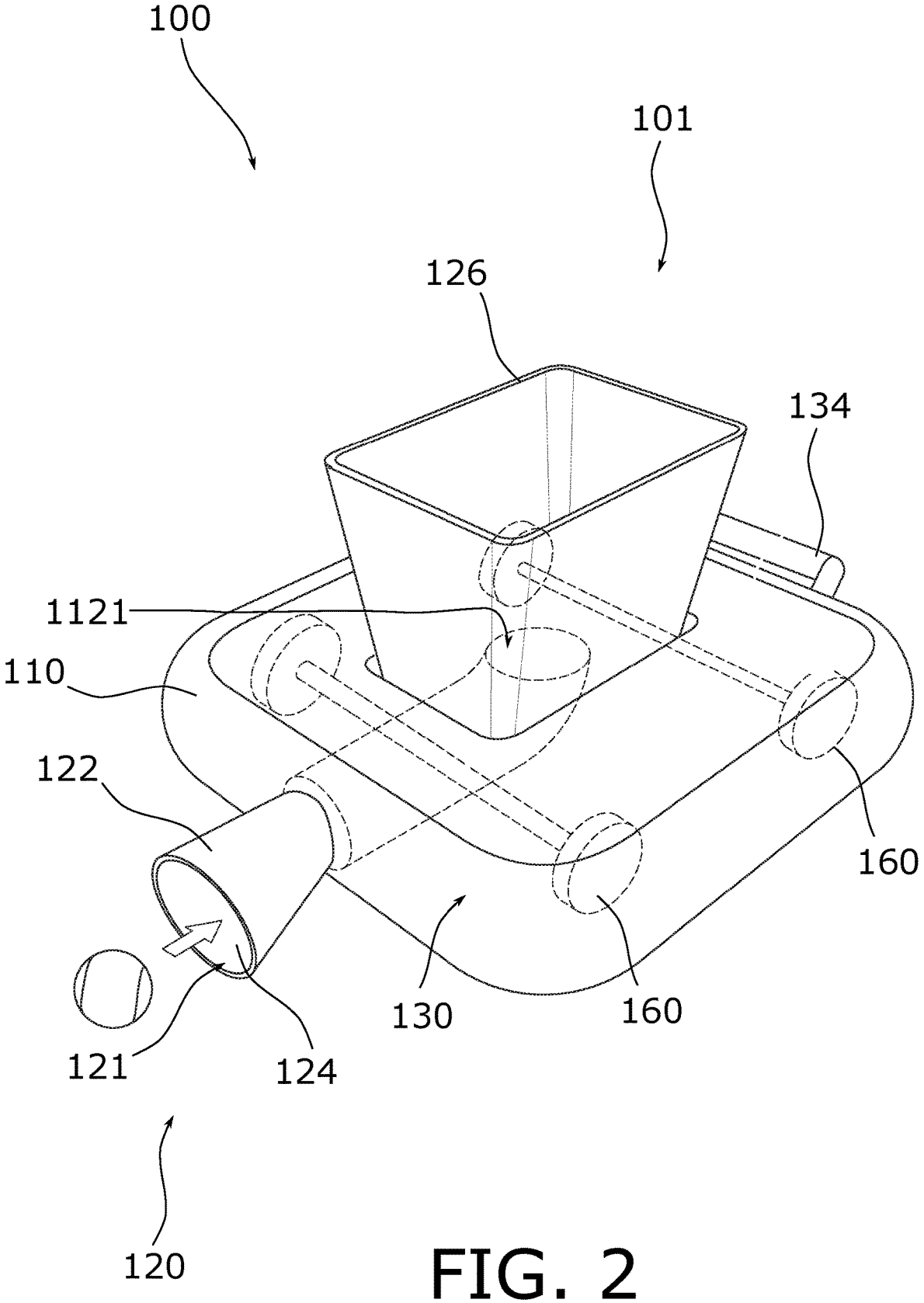
FIG. 2 is a perspective view of a tennis-ball collector.
Figure 3:
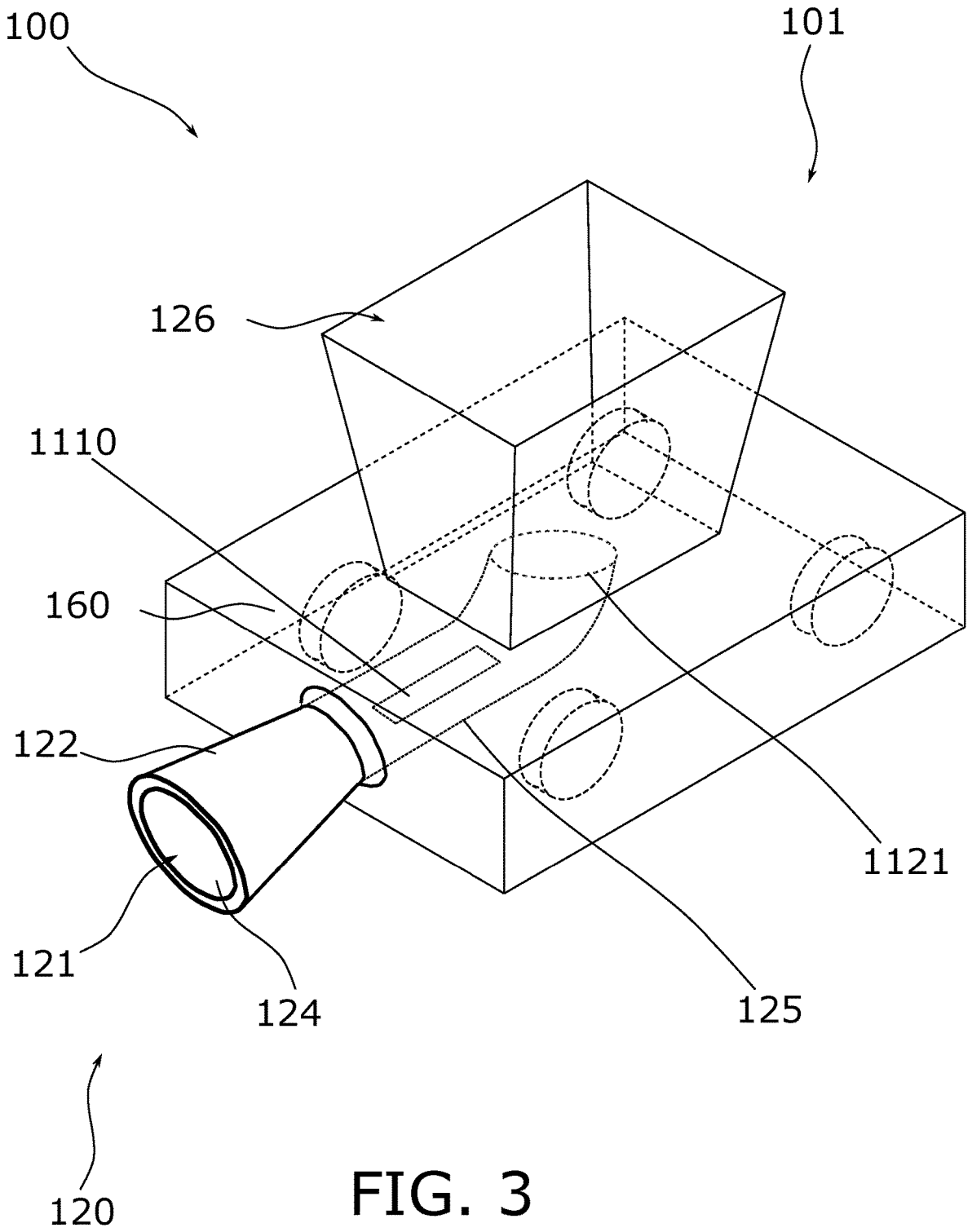
FIG. 3 is a perspective view of a tennis-ball collector.
Figure 4:
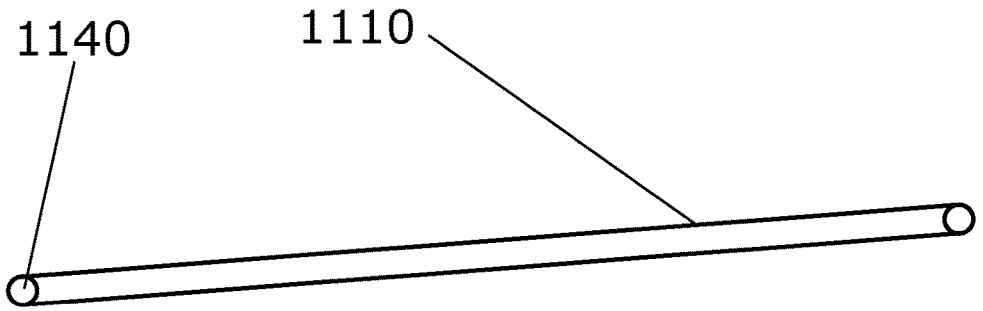
FIG. 4 contains top and side views of a drive belt of a tennis-ball collector.
Figure 4:
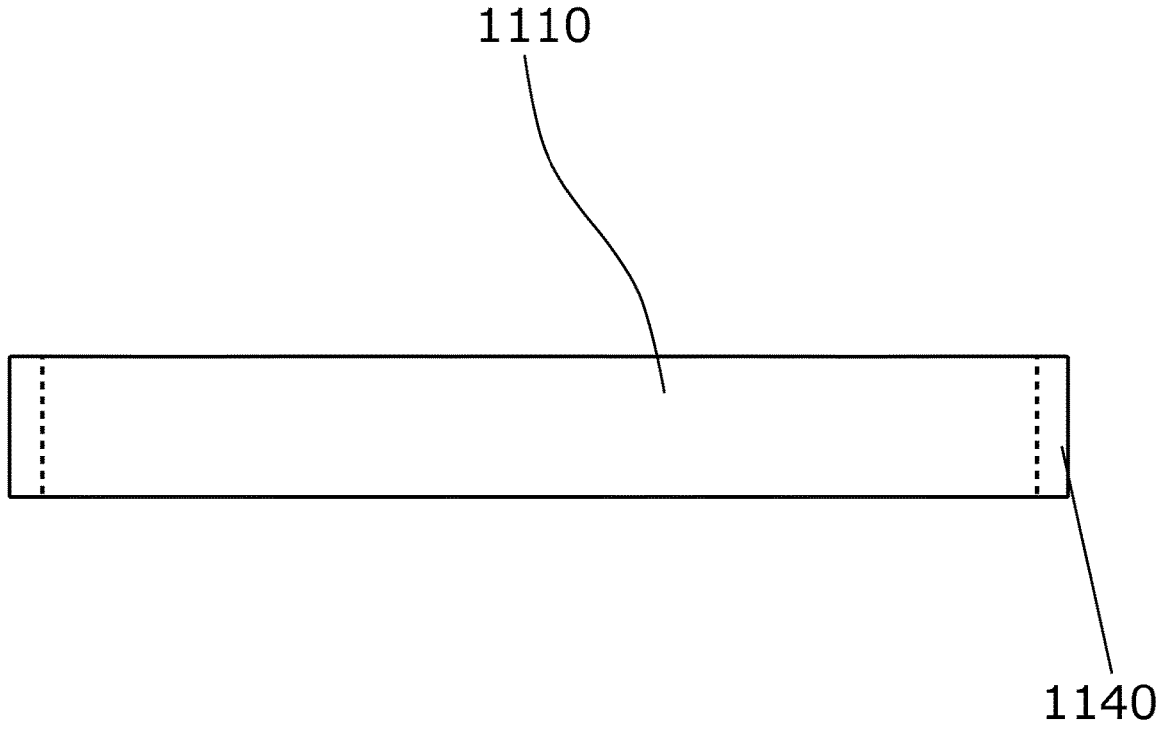

FIG. 2 shows tennis-ball collector system 100 of FIG. 1. System 100 has a tennis-ball collector 101. As above, device 101 may include chassis 110, drive train 130, energy source, wheels 160, and motor. Chassis 110 may include ball collector 120, including inlet 121, ball receiver 122, ball channel 124, and hopper 126. The ball collector 120 may be mounted to the forward outer surface of chassis 110 for allowing balls 5 to travel into ball receiver 122, which, in some examples, activates a vacuum to propel balls 5 into and through ball channel 124 with walls 125 to hopper 126. In other versions, a ball 5 traveling into ball receiver 122 activates drive belt 1110 (FIG. 3) to propel balls 5 into and through ball channel 124 to hopper 126. Hopper 126 may be removably coupled to device 101 to allow removal of hopper 126. Device 101 may also include carrying handle 134 coupled to chassis 110. FIG. 4 depicts a view of drive belt 1110. Drive belt 1110 is installed around rollers 1140. This assembly is mounted in ball collecting device 101, as shown in FIG. 3.

Drive train 130 drive may be coupled inside chassis 110 so that the energy source, wheels 160, and the motor propel chassis 110 around the court. The energy source may be configured to operate using a battery pack, which may use a lithium-ion rechargeable battery. Some examples use at least two wheels 160. Examples adapted to rough terrain may use more wheels 160.

A user employs transmitter 150 to control the collector 101 through a wireless connection. The transmitter 150 controls collector 101 by transmitting movement commands to the receiver in the device radio 1501. The device radio or receiver operate servos to control drive train 130, which moves device 101 into a ball 5 making direct contact with the ball 5, causing the ball 5 to enter ball receiver 122, and in doing so triggers drive belt 1110 that moves balls 5 into and through ball channel 124 to hopper 126.

Figure 5:
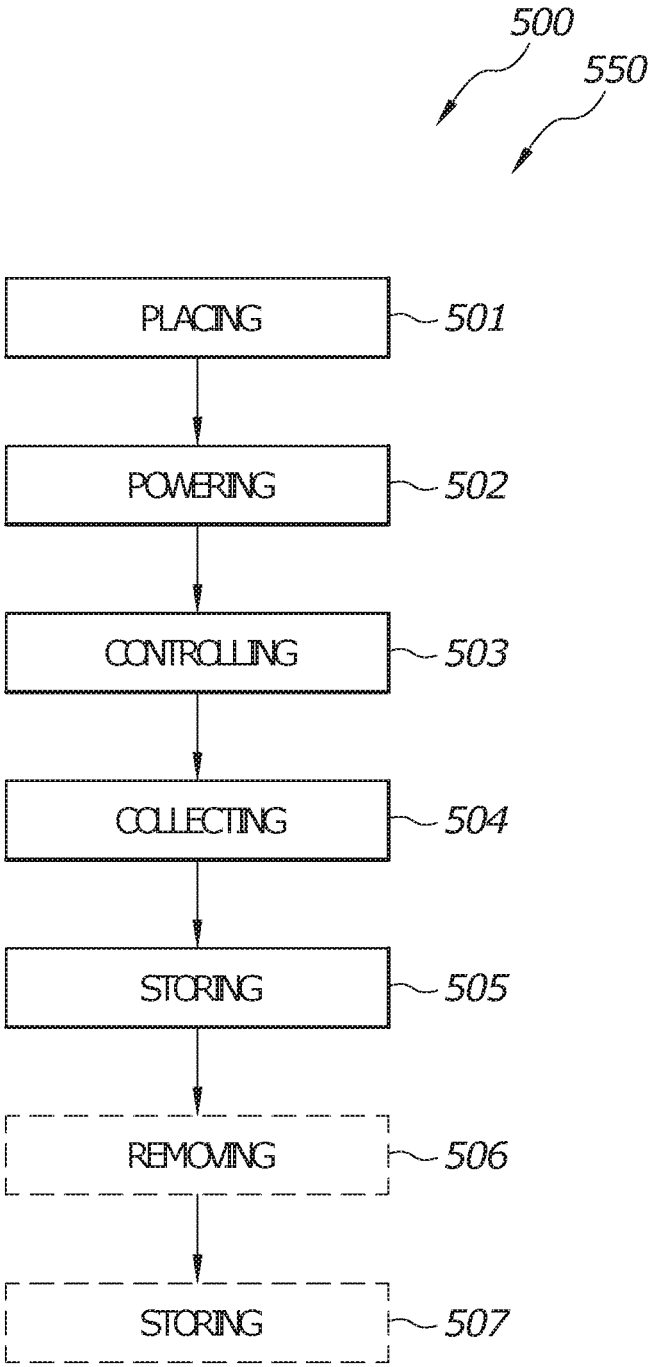
FIG. 5 is a flow diagram illustrating a method of using a tennis-ball collector.

FIG. 5 is a flow diagram 550 illustrating a method 500 for using a device 101. In particular, the method 500 for using a device 101 may include one or more components or features of device 101, as described above. As illustrated, the method 500 for using a device 101 may include the steps of 501, placing the device on the ground; 502, powering the device on; 503, using the remote control for controlling the device; 504, collecting the balls; 505, storing the balls in a hopper; 506, removing the hopper to retrieve the balls; and 507, storing the device.

Steps 506 and 507 are optional and may not be implemented in all cases. Optional steps of method 500 are illustrated using dotted lines in FIG. 5 to distinguish them from the other steps of method 500. The steps described in the method of use can be carried out in many different orders according to user preference. The use of "step of" should not be interpreted as "step for" is not intended to invoke the provisions of 35 U.S.C. § 112(f). Under appropriate circumstances, considering such issues as design preference, user preferences, marketing preferences, cost, structural requirements, available materials, technological advances, etc., other methods for using a tennis-ball collector system are taught herein.

Figure 6A:
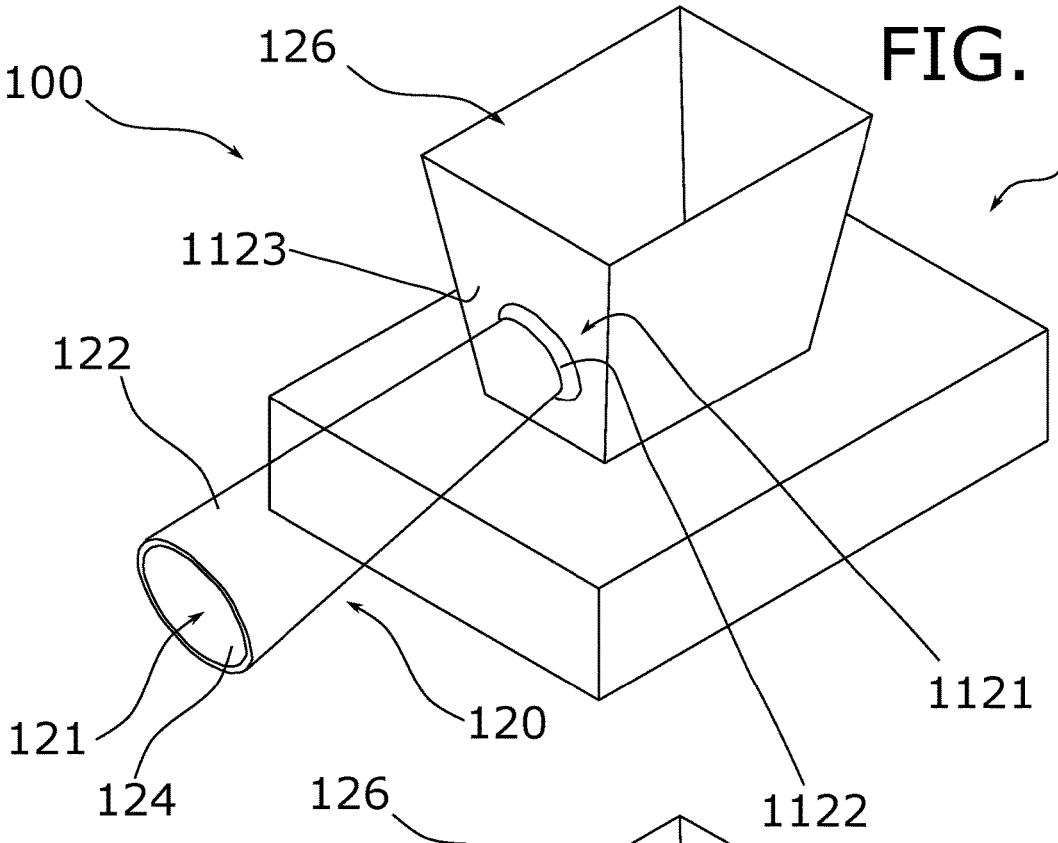
FIG. 6A is a perspective view of a tennis-ball collector.
Figure 6B:
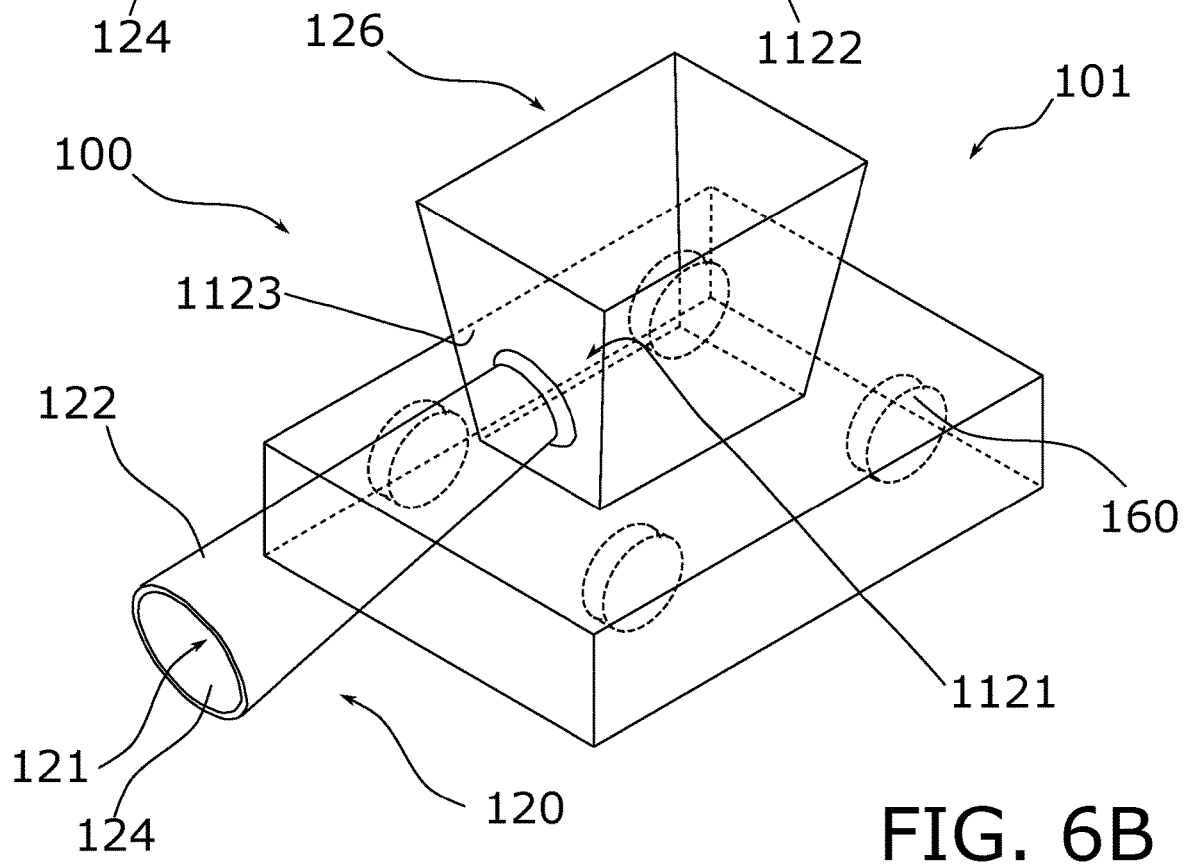
FIG. 6B is a perspective view of a tennis-ball collector.

FIG. 6A and FIG. 6B show another version of tennis-ball collector system 100. System 100 comprises tennis-ball collector 101. As above, device 101 may include a chassis 110, a drive train 130, energy source, wheels 160, and motor. Ball collecting device 101 includes ball collector 120. Ball collector 120 includes inlet 121, ball receiver 122, ball channel 124, and hopper 126. The ball collector 120 mounts to opening 1122, which passes through wall 1123 of hopper 126. Ball collector 120 scoops up ball 5 into ball receiver 122, which, in some examples, activates drive belt 1110 (FIG. 7A and FIG. 7B) to propel ball 5 into and through ball channel 124 through opening 1122 into hopper 126. In some versions, rotating brushes are used in place of drive belt 1110.

As before, ball collecting device 101 comprises a drive train 130, chassis 110, energy source, wheels 160, and motor, which propel ball collecting device 101 around the court.

FIGS. 7 A and 7B show section views of ball collector 120, which includes inlet 121, ball receiver 122, ball channel 124, outlet 1121, and drive belt 1110. Drive belt 1110 operates somewhat like a conveyor belt. It runs on rollers 1140. FIG. 7A shows a flat side of belt 1110. FIG. 7B shows a side view of drive belt 1110 and rollers 1140.

Figure 8:
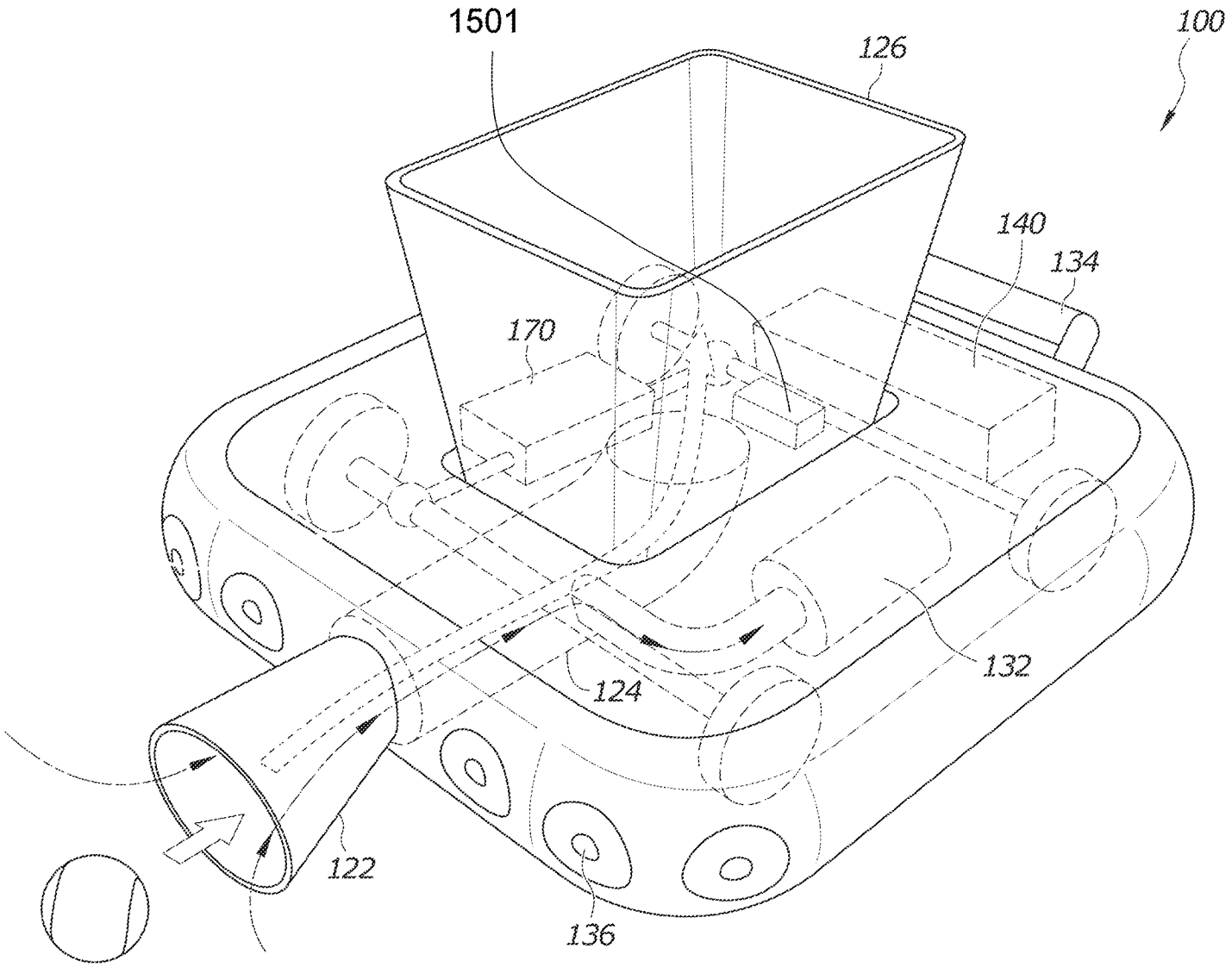
FIG. 8 is a perspective view of an automated tennis ball. Like figure designations denote like elements.

FIG. 8 shows an automated tennis ball collector system. The automated tennis ball collector system 100 may include a chassis 112, a drive train 130, an energy source 140, a plurality of wheels 160, and at least one motor 170.

These embodiments of the invention are exemplary, and numerous modifications, variations, and rearrangements can be readily envisioned to achieve substantially equivalent results, all of which are intended to be embraced within the spirit and scope of the invention. Further, the purpose of the abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A tennis ball collector device for use on a ground surface, comprising: a chassis; a plurality of wheels connected to said chassis and being engageable with said ground surface; a motor connected to certain wheels of said plurality of wheels; an energy source; a drive train connected to said chassis and linked to said motor and energy source to propel said chassis about the ground surface on said certain wheels; a hopper removably mounted to said chassis, said hopper comprising a wall having an opening therethrough; a tennis ball receiver, said tennis ball receiver including a wall portion forming a channel to allow travel of a tennis ball therealong, said receiver including an outlet communicating with said opening of said hopper to allow passage of a tennis ball into said hopper; a drive belt mounted in said channel of said tennis ball receiver to convey a tennis ball on said belt, through said channel to said hopper via said opening of said hopper, said drive belt extending through said opening of said hopper and into said hopper; a radio device disposed in the chassis; and a control unit having a transmitter for transmitting commands to said radio device to actual movement of said chassis through said drivetrain.

2. The device of claim 1 in which said energy source comprises a battery pack.

3. The device of claim 2 in which said battery pack utilizes a lithium-ion rechargeable battery.

4. The device of claim 1 which additionally comprises a carrying handle on said chassis.

* * * * *